United States Patent [19]

Deforeit

[11] 4,422,363

[45] Dec. 27, 1983

[54] METHOD FOR DIGITALLY CONTROLLING THE ENVELOPE CURVE IN A POLYPHONIC MUSICAL SYNTHESIZER AND CIRCUITRY TO IMPLEMENT THE METHOD

[75] Inventor: Christian J. Deforeit, Trossingen, Fed. Rep. of Germany

[73] Assignee: Matth. Hohner AG, Trossingen, Fed. Rep. of Germany

[21] Appl. No.: 276,685

[22] Filed: Jun. 23, 1981

[30] Foreign Application Priority Data

Jun. 24, 1980 [DE] Fed. Rep. of Germany ..... 3023581

[51] Int. Cl.[3] ..... G10H 1/02

[52] U.S. Cl. ..... 84/1.26; 84/1.13

[58] Field of Search ..... 84/1.26, 1.13, 1.24, 84/1.27, 1.03

[56] References Cited

U.S. PATENT DOCUMENTS

| | | | |
|---|---|---|---|
| 4,083,283 | 4/1978 | Hiyoshi et al. | 84/1.26 |
| 4,166,405 | 9/1979 | Hiyoshi et al. | 84/1.26 |
| 4,336,736 | 6/1982 | Mishima | 84/1.26 |

*Primary Examiner*—F. W. Isen

[57] ABSTRACT

Envelope curves for a large number of individual sounds to be digitally synthesized are generated by storing sample envelope shapes. The duration of the stored curves is varied by exercising control over the sampling of the stored envelopes. The smooth transition from one envelope curve to another is accomplished by sampling the new curve at a fast rate until substantially matching values of the previous and new curve are found and then proceeding with the sampling of the new curve at the desired rate.

8 Claims, 20 Drawing Figures

[f]
A7
fmax
f0
A

A8
f0
A
R

A9
f0

A10
f0
A
R fL
f0 f0
fL f0
1.
2.
3.

f0

METHOD FOR DIGITALLY CONTROLLING THE ENVELOPE CURVE IN A POLYPHONIC MUSICAL SYNTHESIZER AND CIRCUITRY TO IMPLEMENT THE METHOD

BACKGROUND OF THE INVENTION (1) Field of the Invention

The present invention relates to the synthesis of sound and particularly to the excercise of control over the envelope of an alternating current signal which is to be transduced into sound in an electronic musical instrument. More specifically, this invention is directed to digital logic circuitry for controlling the envelope of a signal produced in a polyphonic musical synthsizer. Accordingly, the general objects of the present invention are to provide novel and improved methods and apparatus of such character.

(2) Brief Description of the Prior Art

Electronic musical instruments wherein the sound to be created is synthesized from digitally coded information are known in the art. Such digitally operated musical instruments are disclosed, by way of example, in my co-pending applications Ser. Nos. 158,251 and 235,843. The synthesizers disclosed in the referenced co-pending applications produce audio frequency signals through the sampling of the content of "phase counters" and the subsequent integration of the outputs of such "phase counters". Employing the synthesizers of the co-pending applications, the polyphonic generation of audio frequencies is possible and, for purposes of discussion, it may be assumed that eight sounds are to be reproduced simultaneously. As the term "sound" is employed herein it means an individual basic frequency plus the harmonics of that basic frequency which may be characteristic to the particular instrument to be simulated. There may, depending on the instrument, be eight or even ten harmonics and the individual frequencies of these harmonics will hereinafter be referred to as "individual sounds". Thus, a "sound" having five harmonics will comprise six "individual sounds".

In the electronic production of musical sound the harmonic content of the "sound" is but one of several criteria which must be met in order to produce the requisite audible information. Thus, it is equally important that the appropriate envelope curve be generated, i.e., the amplitude variation over time including both the "attack" and "decay" portions of the curve. In other words, the shape of the envelope will vary for the same basic frequency from instrument to instrument and these variations must be taken into account in the synthesis process. Also, in addition to the amplitude variations, there are also frequency variations, i.e., the characteristic chord instrument vibrato.

To summarize the preceding brief discussion, a musical synthesizer must be able to generate two hundred or more different envelope curves in order to take into account the possible sounds the user of the electronic instrument may desire to produce. The typical prior art musical synthesizer generates an envelope curve which takes into account the attack and decay phases of just one individual sound while the remaining individual sounds which are being simultaneously reproduced remain unaffected in amplitude and frequency. If a plurality of envelope curves must be simultaneously produced, accordingly, the number or circuits employed for this purpose must be multiplied by the number of curves to be simultaneously produced.

A proposed synthesizer circuit is disclosed in U.S. Pat. No. 4,083,285. The circuit of this patent would permit variation of the envelope curves of the harmonics of a "sound" in addition to the basic "individual sound". This patent also suggests the use of a "sound color memory" which holds data during the "attack" period when the envelope is varying from initiation of the "sound" in the customary or predetermined manner, during the decay period, and also holds maximum amplitude and sustain amplitude data. The data in this "sound color memory" is sampled in a time multiplex mode and applied as an input to a control unit. While the use of a "sound color memory" reduces the memory capacity required in the apparatus, the above-discussed problem of prior art synthesizers is not overcome since the ability to vary envelope curve shape is quite restricted. This restricted ability to vary envelope shape results from the fact that only a single envelope, although one which is frequently desired, may be generated. For further amplitude shapes, including amplitude modulation, frequency modulation, repetition, etc., additional complex circuits would be required.

SUMMARY OF THE INVENTION

The present invention overcomes the above-briefly discussed and other deficiencies and disadvantages of the prior art by providing a novel and improved method for digitally controlling the shape of the envelope of the polyphonic audio frequency signal provided by a musical synthesizer. The present invention also comprises apparatus for use in the practice of this novel method wherein circuit complexity is greatly reduced in comparison to the prior art, while a very great number of individual sounds may be varied with regard to their envelope curves.

In accordance with the preferred embodiment of the present invention, envelope curves for a very great number of individual sounds (frequencies) are stored in a read only memory, the addresses of the stored curve samples are stored in a random access memory as the corresponding individual sounds are required to be produced, the memorized addresses are rapidly read sequentially and the stored curves commensurate with these addresses are sampled. The sampled curves are delivered to a polyphonic sound synthesizer to control the envelope of the signals provided thereby.

BRIEF DESCRIPTION OF THE DRAWING

The present invention may be better understood and its numerous objects and advantages will become apparent to those skilled in the art by reference to the accompanying drawing wherein.

DESCRIPTION OF THE PREFERRED EMBODIMENT

Figure 1A:
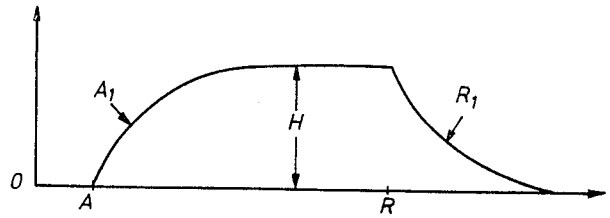
FIGS. 1*a*–1*g* illustrate envelope curves of the type frequently desired in electronic musical instruments which have time-dependent amplitude variations.

With reference now to the drawing, in FIGS. 1*a*–1*g* the variation in the amplitude of an individual sound with time is represented graphically. In an electronic musical instrument an individual sound is, of course, a sinusoidal oscillation. A "sound" comprised of the basic oscillation or individual sound with its harmonics will consist of square pulses, triangular pulses or other pulse shapes. These pulse shapes, however, are of no interest in the analysis of FIG. 1 which shows the variations in the peak amplitudes with time. In viewing FIG. 1 it must be remembered that the "attack" and "decay" of a sound normally will follow an exponential function because these portions of the envelope are transitional events which may be periodical ("vibraphon") or aperiodical. Further, it must be remembered that the illustrated curves do not signify the sound volume which can be varied at will be the user of the instrument. Any such volume variation would simply expand or contract the ordinate scale of the curves shown in FIG. 1.

With regard to the abscissa, i.e., the duration of the transitions, it must be observed that the curves will vary quite drastically for different instruments which are to be simulated. Additionally, the duration of the transitions may be different for the "individual sounds" which comprise a "sound". As will become apparent to those skilled in the art from the discussion below, one of the substantial advantages of the present invention resides in the fact that the permanent memory of the apparatus need only store the envelope curve shape since the actual duration of its reproduction will be externally commanded as a function of the type of instrument to be simulated. This unique technique permits considerable reduction in memory capacity.

For all of the above-stated reasons, the diagrams of FIG. 1 have not been provided with scales for either the abscissa or the ordinate. Thus, only the instants at which a "release" command is generated by the instrument user have been indicated. The initiation of generation of a sound has thus been represented by "A" while "R" indicates termination. In terms of a keyboard instrument, initiation means the actuation of the respective instrument key or the like by the user while termination means that this actuation has ceased, i.e., the key has been released. The commands "A" and "R" will initiate the generation of different envelope curves.

In the most basic case illustrated, FIG. 1*a*, the amplitude of the envelope curve increases following an aperiodical exponential function from the instant of initiation A in accordance with a first envelope curve $A_1$ to a maximum amplitude H. The amplitude remains at H until the instant of termination R whereupon the amplitude decreases to 0 in accordance with an aperiodical exponential function $R_1$. Although curves $A_1$ and $R_1$ may be of similar shape, they will be separately stored in the memory of the apparatus.

Figure 1B:
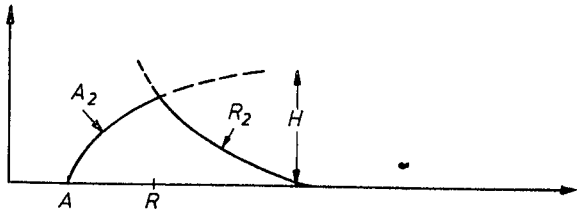

FIG. 1*b* illustrates the situation where the user provides the termination command R prior to the attack envelope curve $A_1$ having reached the nominal maximum amplitude H. This results in a reduced attack envelope $A_2$. This reduced attack envelope may not be followed by decay curve $R_1$ since this would require an amplitude jump. Thus, the reduced attack envelope $A_2$ should, at least approximately, be followed by an accordingly reduced decay curve $R_2$. The manner in which this is accomplished in accordance with the present invention will be described below.

Figure 1C:
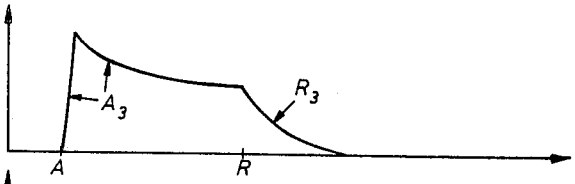

FIG. 1*c* illustrates an attack envelope curve $A_3$ which is characteristic of a piano. The amplitude of curve $A_3$ increases rapidly to a maximum value and then decreases exponentially. Upon release of the "piano key" the oscillation will be attenuated and the curve $A_3$ must thus be followed by a decay curve $R_3$ without any sudden variations in amplitude. The curve of FIG. 1*c* is thus a particular sub-case of FIG. 1*b*.

Figure 1D:
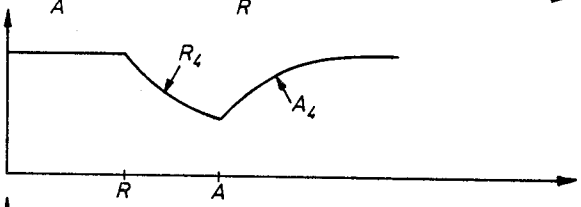

A similar situation to that described above in the discussion of FIGS. 1*b* and 1*c* will occur if a "terminated" sound is "reinitiated" before the decay curve has reached the 0 amplitude level. Thus, as shown in FIG. 1*d*, the decay envelope curve $R_4$ must, at least approximately, be followed by an attack envelope curve $A_4$, which begins at time A, which corresponds to the reactuation of the key in the case of a piano.

Figure 1E:
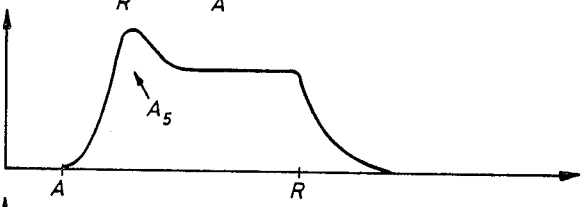

Another shape of envelope, having transitional oscillations typical of a brass instrument, is depicted in FIG. 1*e* at $A_5$.

Figure 1F:
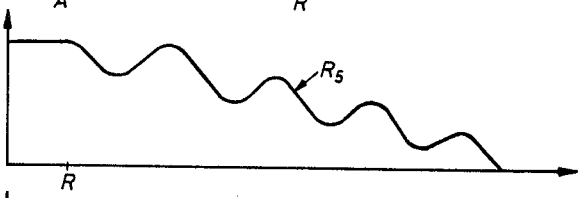

FIG. 1*f* shows an envelope $R_5$ which includes subaudio modulation. An envelope curve such as that of FIG. 1*f* is needed to simulate a vibraphone.

Figure 1G:
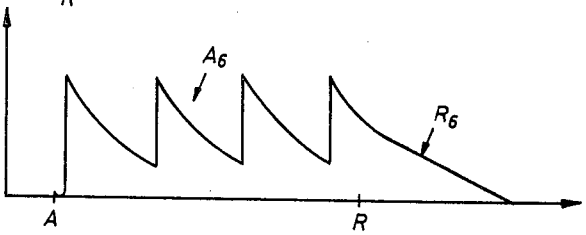
Figure 4:
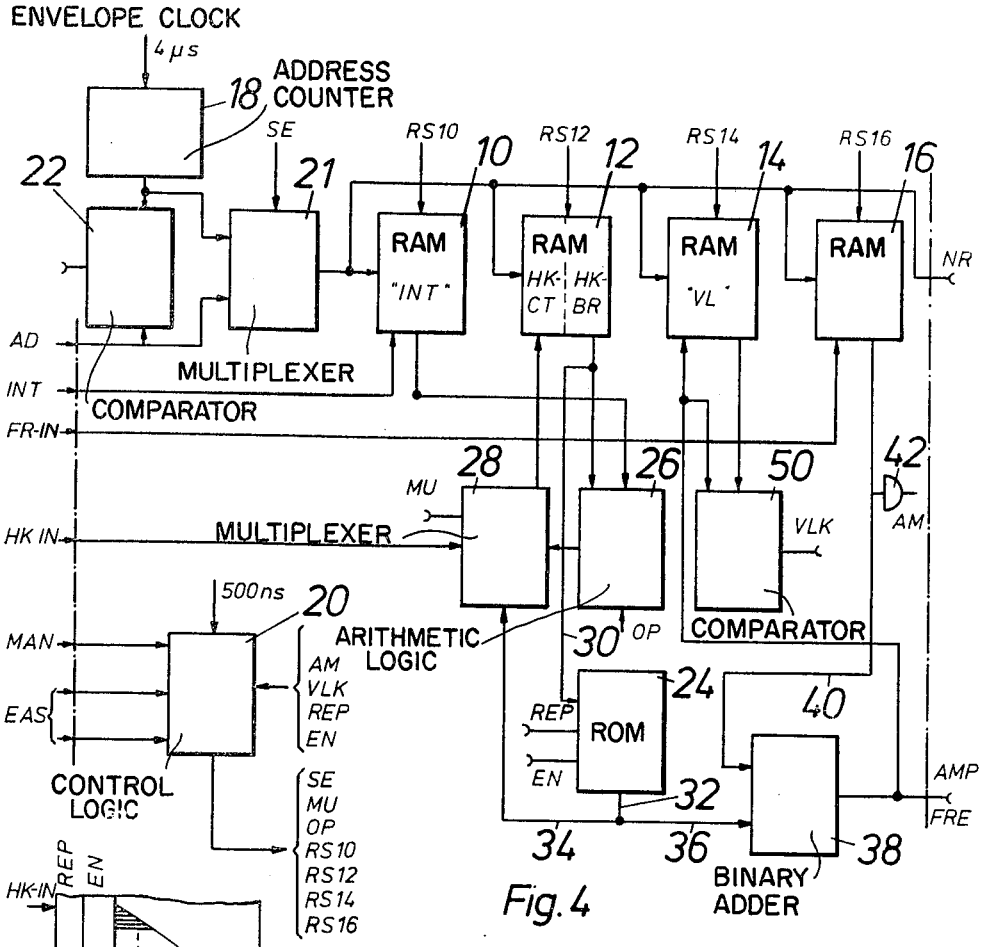
FIG. 4 is a circuit block diagram of apparatus in accordance with a preferred embodiment of the present invention.

Turning now to FIG. 1*g*, an attack envelope curve $A_6$ consisting of a plurality of repetitions of the same curve, particularly the attack curve $A_3$ of FIG. 1*c*, is shown. In FIG. 1*g* the abscissa or time scale has been reduced. The preferred embodiment of the present invention, as depicted in FIG. 4, enables the reproduction of the envelope of FIG. 1*g* with only the curve $A_3$ being permanently stored in the memory of the apparatus. An envelope of the type depicted in FIG. 1*g* is necessary to simulate instruments such as the mandolin and banjo. In FIG. 1*g* the decay curve $R_6$ comprises the extension of the attack curve to 0 amplitude from the time of release R.

Referring now to FIG. 2, variations in frequency with time are illustrated. The comments above with regard to the scale of both the ordinate and abscissa of the curves of FIG. 1 are equally applicable to FIG. 2. Externally commanded time scales are employed, in the manner which will become apparent from the description of FIG. 4, to read the degree of frequency modulation from the memory of the apparatus at the address where the curve is stored.

Figures 2A, 2B, 2C, 2D, 3A, 3B, 3C:
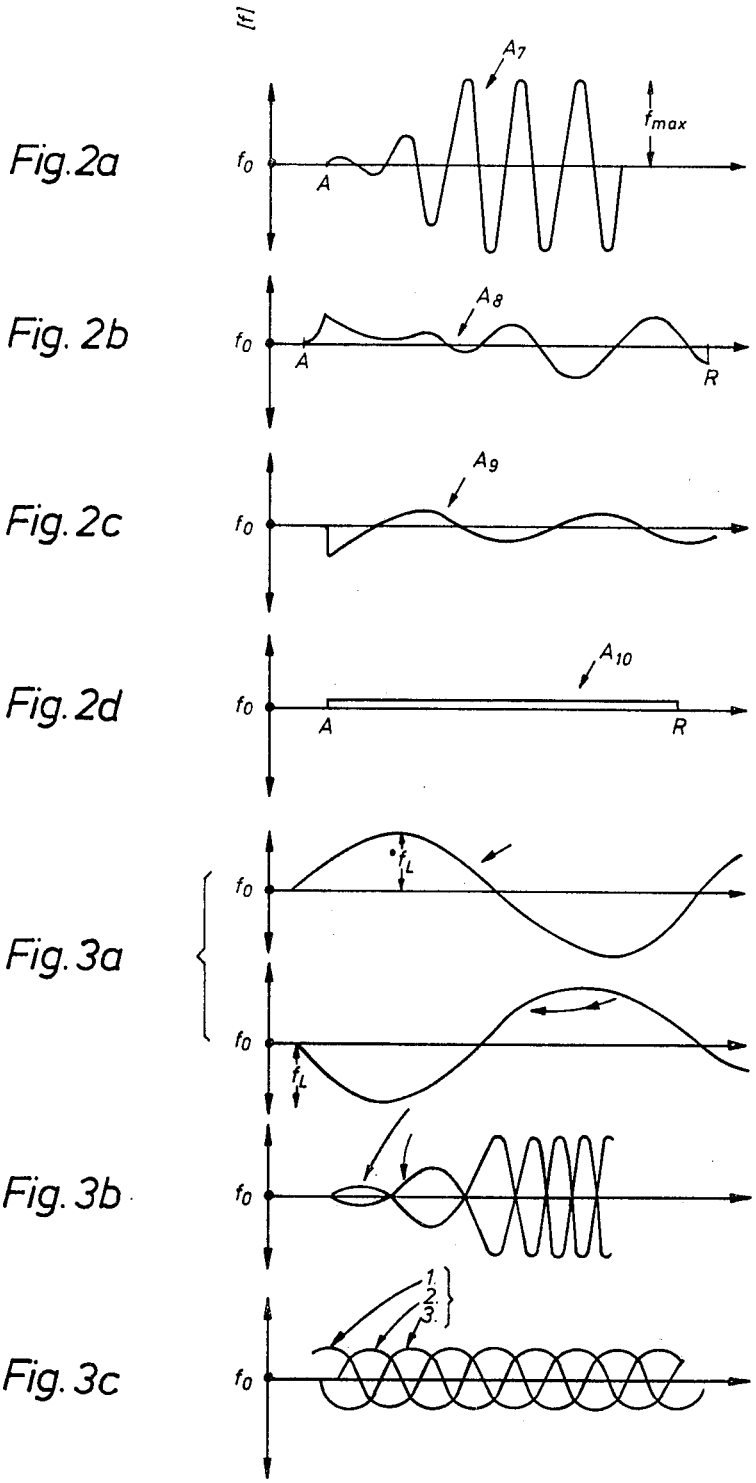
FIGS. 2*a*–2*d* illustrate envelope curves having time-dependent frequency variations.
FIGS. 3*a*–3*c* are further illustrative envelope curves of the type which typically are desired to be generated by electronic organs.

FIG. 2*a* represents an attack envelope $A_7$ where the frequency f oscillates about a carrier frequency $f_o$ with a slowly increasing modulation degree. Upon the reaching of the maximum frequency $f_{max}$ the frequency variation will repeat as long as the sound is played. This type of frequency variation is known as "normal decelerated vibrato". As will become obvious to those skilled in the art from the discussion of FIG. 4, this "normal decelerated vibrato" may be easily implemented by the present invention.

FIG. 2*b* shows a frequency modulation envelope characteristic of a guitar at $A_8$. Beginning with a frequency slightly higher than the nominal frequency $f_o$, frequency will vary in accordance curve $A_8$ until the nominal frequency is reached whereafter the envelope will become similar to that depicted in FIG. 2*a*.

FIG. 2*c* shows a curve, representing an envelope which is somewhat inverted with respect to that of FIG. 2*b*, which results from the first blow into a brass instrument.

FIG. 2*d* illustrates the "chorus" effect, i.e., the simultaneous reproduction $A_{10}$ of several nominally unifrequent oscillations which, in reality, are slightly different.

FIG. 3 illustrates three examples of "special" effects of the type which would typically be required to be produced by an electronic organ. FIG. 3*a* relates to the so-called Leslie effect which is normally generated by a rotating loudspeaker. Such a rotating loudspeaker causes the listener to receive the impression of a frequency which varies sinusoidally about the nominal frequency with modulation degree $f_L$. This affect may be produced through appropriate envelope curve control by feeding two audio channels with signals which are shifted 180° in phase, the modulation degree $f_L$ being introduced as a frequency modulation envelope curve. This envelope curve repetition may also be implemented by the apparatus of FIG. 4.

FIG. 3*b* illustrates that the Leslie affect may also vary over time to simulate acceleration or deceleration of the rate of rotation of the loudspeaker, the modulation degree $f_L$ thus requiring variation.

In a similar manner, as represented by FIG. 3*c*, the accord of several chord instruments, for example several guitars or a piano which has a plurality of chords for each key, may be simulated. FIG. 3*c* shows a phase shift of 120° for each individual sound. The envelope of FIG. 3*c* may also be created employing the circuit of FIG. 4 using a unique envelope curve repetition technique.

FIG. 4 is a block diagram of a circuit in accordance with a first embodiment of the present invention. The circuit of FIG. 4 may form a modification of a prior art electronic musical instrument synthesizer of the type disclosed in my above-referenced co-pending applications, the disclosures of which are incorporated herein by reference. The circuit of the present invention provides digital output signals AMP and FRE which define the envelope curve of the output signal to be produced by a "sound block" in the instrument, each individual sound to be produced being correlated with one of such "sound blocks". The digital signals AMP and FRE, respectively, control the amplitude and frequency of the envelope which is produced. The individual sound blocks, i.e., the phase counters of the instrument, are opertated in a time multiplex technique. The "sound blocks" being state-of-the-art, they have been omitted from the drawing of the instant application and it will be understood that these prior circuits would be connected to the right of the broken line at the right side of FIG. 4. The output signals generated by the circuit of the present invention include the number of the respective synthesis block, i.e., its address, and the above-mentioned envelope data AMP/FRE which is to be transmitted to the addressed block.

An electronic instrument which includes the circuit of FIG. 4 would receive the customary inputs from manuals, pedals, knobs, register switches and the like. The instrument will include coding circuits which produce control signals commensurate with the actuation events of the user operated input command signal generating devices. Those generated control signals, which are transmitted directly to the synthesizer blocks, will not be discussed herein. The signals which are delivered to the envelope control circuit of FIG. 4 are as follows:

AD: The current address which defines the synthesizer block NR which is to be provided with a control signal from the envelope curve control circuit at a given instant within the time multiplex frame.

INT: A digital value commensurate with the real time interval within which a predetermined, i.e., memorized envelope curve shape, must be followed from initiation to termination. This input determines the scale of the abscissa of the curves of FIGS. 1, 2 and 3.

FR-IN: A digital value which defines the frequency $f_o$ in the case of a frequency modulation envelope curve. This input also serves to distinguish between frequency modulation and pure amplitude modulation. Thus, with FR-IN=0 there will be amplitude modulation only.

HK-IN: This digital value defines the envelope curve to be reproduced. HK-IN is a ROM address of the memory element where the beginning of the envelope curve to be scanned is stored.

MAN: Indicates whether or a not a certain individual sound is to be generated. If this signal has logic level 0 the sound is to be generated and the input will go to logic level 1 if the sound is to to terminated. Accordingly, a change in this input 0-1 is the command for a decay envelope while a 1-0 change commands an attack envelope.

ESA: These are the connections for input and output signals of the control logic for the circuit.

The apparatus of FIG. 4 includes four random access memories 10, 12, 14 and 16 which are addressed by the AD input signals. The four RAMs have a storage capacity equal to or greater than the number of envelope curves which may be simultaneously generated and, as indicated above, this number may exceed 200. In one reduction to practice of the invention each RAM will have 256 memory elements all having homologous addresses. These addresses will be the numbers of the respective sound synthesis circuit blocks.

If the RAMs 10, 12, 14 and 16 are addressed by a AD input, externally supplied data corresponding to INT, FR-IN and HK-CT (to be explained below) may be written into the appropriate memory. The reading of data from the RAMs is responsive to the addressing of the memories by an address counter 18 which is regularly clocked at, for example, intervals of 4 μsec. The input to counter 18 is referred to as the "envelope clock" which may be distinguished from the system clock which provides clock pulses to control logic 20 to form the basis for the entire time multiplexing of the circuit. In the embodiment being described, the system clock may operate with a 500 nanosec. interval between pulses. There is, of course, considerable latitude in the selection of clock pulse rate. A 4 μsec. envelope clock is appropriate because, for a musically satisfactory envelope reproduction, an envelope sample should be calculated each millisecond. This requires that the 256 memory elements of RAMs 10, 12, 14 and 16 must all be addressed once within a milisecond. A 4 μsec. clock is, in terms of present logic circuitry, relatively slow.

The externally supplied addresses AD or the addresses which appear at the output of address counter 18 are passed by a multiplexer 21 to the RAMs. Multiplexer 21 has a control input SE. The simultaneous delivery of input information to the RAMs and the read-out of these memories must be avoided and thus, in the case of simultaneous AD inputs and an output from address counter 18, a comparator 22 will produce a BUSY signal which is delivered to control logic 20 from comparator 22. This BUSY signal, in turn, causes the control logic to produce the SE signal which disables the multiplexer 21 from access by the addresses generated by counter 18.

The RAM 10 will store the binary word commensurate with the INT input, i.e., the digitally coded value of the real time interval within which an envelope curve shape stored in a ROM 24 is to be utilized for control purposes. RAM 12 stores, in a left hand portion of the memory which is designated HK-CT, the current addresses of envelope curve samples held in ROM 24. The "address totals" of the ROM 24 are currently updated in RAM 12. In the right hand portion of RAM 12, designated as HK-BR, the "address fractions" of ROM 24 are currently updated. In order to reproduce the envelope curve samples which are stored only once in ROM 24, within different real time intervals as established by the INT input to the circuit, this desired real time interval is stored in RAM 10 in the form of an address fraction, i.e., as a compliment. Thus, by way of example, if the envelope should last for twice the time established by the envelope clock input to counter 18 and number of envelope samples, the next-following sample will not be read out upon the next following address pulse for the respective memory element but only upon every other address pulse.

Although the circuit of FIG. 4 actually operates in accordance with a binary system, it is believed that understanding of the invention will be facilitated by explaining the events which occur in terms of decimal numbers. If it is assumed that RAM 10 holds the fraction "0.25", which means that the envelope curve should last four times longer than the stored curve, the value in RAM 10 will be delivered as an input to an arithmetic logic unit 26 upon the addressing of RAM 10 by counter 18. The second input to arithmetic logic unit 26 is the current value of HK-CT stored in RAM 12. The logic unit 26 adds the fraction values and the total is read, via multiplexer 28, into RAM 12 to update the fraction data by the value read from RAM 10. The addresses of the envelope curve samples in ROM 24, on the contrary, are always "totals" or "integers". In the example being considered, the next address for the ROM, in portion HK-CT of RAM 12, will appear after four addressing occurences by counter 18. This means that an updated sample will be read from ROM 24 only after four milliseconds and this same sample will be read thereafter three more times before an updated address is written into RAM 12. The initial address of the ROM 24, where the beginning of the envelope curve being followed is stored, was written into RAM 12 first, as signal KH-IN, via multiplexer 28 under the control of a signal MU produced by control logic 20 which, in turn, operated in response to the MAN input.

The multiplexer 28 is three channel multiplexer. Accordingly, ROM addresses may be written into portion HK-CT of RAM 12 "back" or directly from the read only memory 24 itself.

In considering the operation of the present invention, clear distinction must be made between the "addresses" of the memory elements and the data or contents held in these elements. Thus, ROM 24 is addressed via conductor 30 from RAM 12 and will produce data on output line 32. In the operational mode discussed immediately above, the data produced by ROM 24 will have the "meaning" of an ROM address if and when this data is transmitted to RAM 12 via line 34 and multiplexer 28. This, however, is the exceptional case. Generally, ROM 24 stores samples of the envelope or, in the case frequency modulation, the values of the modulation degree.

The results of the foregoing is that, with the counting of counter 18, the envelope or a portion thereof stored at the address memory location in ROM 24 will be followed beginning at the address fed back from ROM 24 to RAM 12 with the real time being determined by the data stored in RAM 10. If an envelope or a portion thereof is to be repeated, the respective command signal is readable in ROM 24 under an allocated address and appears on output REP of the ROM. The REP output of ROM 24 is delievered to logic unit 20 and causes the switching of multiplexer 28 to the allocated channel. If an envelope has been completely read from ROM 24, an EN signal will be provided by the memory. This EN signal, when delivered to control logic 20, will cause the control logic to erase the memory elements under the respective address in the RAMs. Thereafter, depending on the level of the MAN input, either the unmodulated sound will continue or will cease. The term "unmodulated", as presently used, refers only to an envelope modulation produced under the action of the circuit of FIG. 4. It is to be understood that, by means of other circuitry comprising the electronic musical instrument, another modulation of sound may be provided.

The envelope data read from ROM 24 on line 36 is delivered as the first input to a binary adder 38. The envelope data is, in the case of pure amplitude modulation, in form of signless sample values. In the case of frequency modulation, the envelope data comprises signed degree values. Adder 38 receives a control input, via line 40, indicating whether or not the sound to be synthesized is frequency modulated. This information is stored in RAM 16 where the respective carrier frequencies $f_o$ for each of the 256 envelops to be generated are stored. Thus, the information FR-IN indicates whether the envelope to be generated is pure amplitude modulation. The delivery of the information read from ROM 24 to either amplitude modulation or frequency modulation blocks of the synthesizer circuit is controlled by the output of a gate 42 which provides an AM output signal only in the case of amplitude modulation. The output of binary adder 38 will nevertheless be an envelope value commensurate with the individual sound to be generated.

Figure 5A:
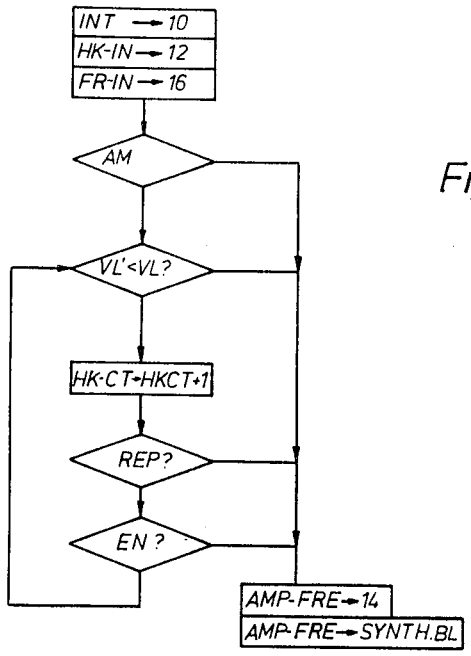
FIGS. 5*a*–5*c* comprise information flow diagrams which represent the operation of the circuit of FIG. 4.
Figure 5B:
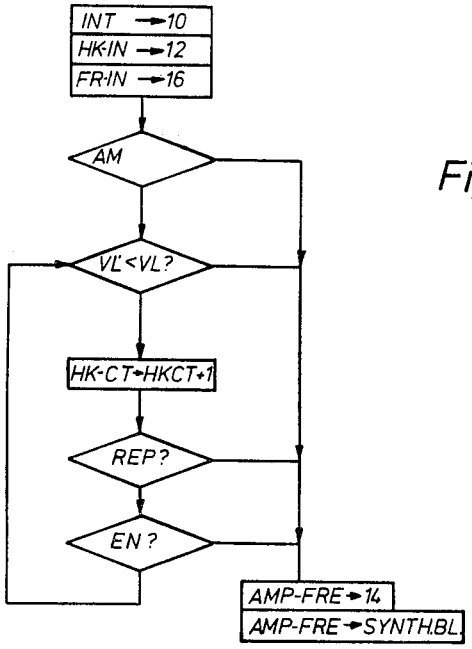

The operation of the embodiment of FIG. 4 will now be discussed in the case of an "interrupted" envelope as represented, for example, in FIGS. 1*b*–1*g*. Understanding of this mode of operation will be facilitated by jointly referring to FIGS. 4 and 5. If an envelope curve which is being generated is interrupted and a new curve should commence, an address change in ROM 24 must take place. Further, the "new" envelope must not begin at the address HK-IN because this address defines the sample "zero" for attack envelopes and the sample "H" for decay envelopes. Thus, the reading of ROM 24 must commence at an address where a sample is stored which is at least approximately equal to the one at which the previous envelope was interrupted. This was described above in the discussion of FIG. 1*b*. Accordingly, the last sample of the interrupted envelope must be memorized and, in ROM 24, that memory element of the "continuing" envelope must be found where an at least approximately equal sample will be found. When that memory element is located, the allotted address will become the "initial" address to be fed to RAM 12.

To accomplish the foregoing, the current sample value VL present at the output of binary adder 38 will be read into RAM 14 at the memory location addressed by the output of counter 18. This same sample value VL is delivered as a first input to a comparator 50. The second input to comparator 50 will be the immediately preceding value VL' which will be read from RAM 14 upon addressing of this RAM by counter 18. The comparator 50 thus produces a logic signal, designated VLK, which will be present as long as the later value VL is smaller than the previous value VL'. This VLK logic signal is delivered as an input to the control logic 20.

The VLK signal is required by control logic 20 only at the instant at which a change in the MAN signal indicates the necessity to change the envelope curve. To first consider the case where a decay envelope is interrupted, indicated by MAN change 1 to 0, and is to be continued by an attack envelope, HK-IN will designate the allotted ROM address where, as an initial sample of an attack envelope, the sample zero will be found. The latter appears at the output of adder 38 as an updated VL value. The immediately preceding value VL' resulting from the interrupted envelope will exceed the VL value whereby comparator 50 will produce the VLK logic signal. Logic control unit 20 will thus generate the command signal OT which causes the arithmetic logic 26 to increment the stored address HK-CT of ROM 24 by one integer. This mode of operation is repeated at the system clock speed until the VLK signal reverts to its initial state as a consequence of comparator 50 no longer detecting any value difference. The address HK-CT which at this instant is stored in RAM 12 will therefore be the "initial" address of the continuing envelope.

The above-described adding of ROM addresses produces the desired result because, for attack envelopes, greater sample values will be stored under greater addresses of the ROM 24. This, however, is not true for decay envelope curves where smaller samples are stored under greater addresses. Accordingly, the updating procedure must be controlled by the complement VLK level in the case of interrupted decay envelope curves. The control logic unit 20 is able to perform this distinction because it may distinquish between transitions 0-1 and 1-0 at the MAN output.

Figure 5C:
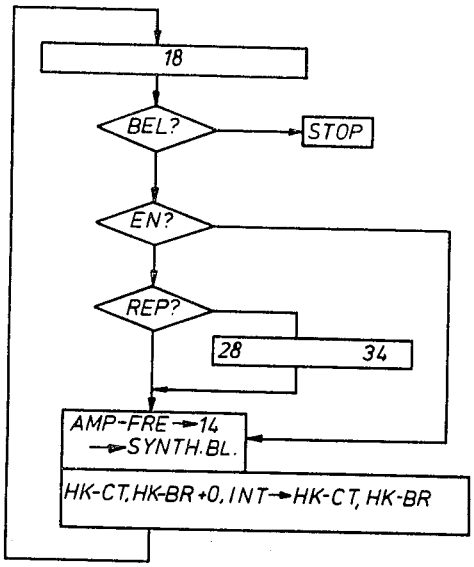

The information flow diagrams 5*a* and 5*b*, respectively, summarize the operations described immediately above. FIG. 5*c* illustrates the operation upon the clocking of counter 18 in the "normal" case where an envelope curve is followed to completion.

Figure 6:
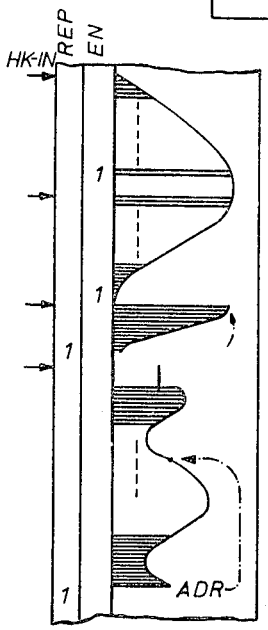
FIG. 6 i a schematic illustration of characteristic envelope curves which are permanently stored in a memory in the apparatus of FIG. 4.

With reference now to FIG. 6, the organization of ROM 24 is shown schematically. The envelope curve samples are illustrated in the form of analog equivalents although, of course, they are binary words. Proceeding vertically downwards, accordingly, the envelopes shown are commensurate with "slow attack", "decay", "percussion including repetition" and "delayed vibrato including repetition". The first bit of each curve sample word is the logic signal REP while the second bit is logic signal EN. The following bits define the sample values or, in combination with RP, equal 1, the address from which the samples are to again be read out. In FIG. 6 the broken line arrows indicate the address to which one must return for a repetition sequence. The initial address where an envelope starts in externally introduced as KH-IN.

Figure 7:
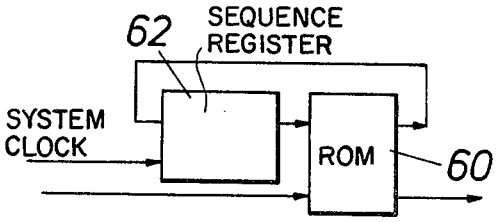
FIG. 7 is a block diagram which schematically illustrates the control logic for the apparatus of FIG. 4.

The control logic unit 20 may, as shown in FIG. 7, comprise an additional ROM 60 to which, as addresses, the above-mentioned logic signals are supplied. The ROM 60 will be read out by means of sequence register 62 which is clocked by the system clock. The required logic sequence is written into register 62 from ROM 60 itself. Under the addresses of the latter, the control signals required by the logic unit may be read out.

It will be understood that the described and illustrated embodiment is only a preferred example of the present invention and that the method of the present invention may be implemented by other means. By way of example, the circuit of FIG. 4 may be modified such that ROM 24 is replaced by a random access memory feed externally with envelope curve data. Further, it is to be understood that the invention is not limited to the types of envelopes illustrated. Accordingly, in an analog circuit implementation of the invention the envelopes would be produced by means of voltage control amplifiers, in the case of amplitude modulation, or voltage controlled oscillators, in the case of frequency modulation. It is also to be noted that, in accordance with the present invention, envelopes may be generated which include resonance effects and the like, the foregoing being accomplished, for example, by analog circuits which employ voltage controlled filters. Accordingly, the present invention has been described by way of illustration and not limitation.

What is claimed is:

1. A method for digitally generating envelope curves for the sounds to be produced by a polyphonic electronic musical instrument comprising the steps of:

permanently storing a plurality of envelope curve samples, each stored curve sample being comprised of bits of value information which define a sound;

storing the addresses of those of the stored curve samples which are commensurate with the individual sounds to be produced sequentially reading the stored curve sample addresses;

reading a stored curve sample at a first rate of speed when its stored address is read;

storing the instantaneous value information of the envelope curve sample presently being read;

generating a curve change command when it is desired to change from producing the sound commensurate with the present envelope curve sample which is being read to a sound commensurate with another envelope curve;

sampling the said another envelope curve sample at a second rate of speed in response to the generation of a curve change command, the second rate of speed being greater than the first rate of speed;

comparing the stored instantaneous value information of the present envelope sample curve with the value information of the said another envelope curve during sampling thereof;

initiating reading of the said another envelope curve sample when the comparison indicates that the value information of the said another curve has equaled the stored value information of the present curve; and delivering the envelope curve sample being read to modulation controls in an instrument.

2. The method of claim 1 wherein each envelope curve sample is permanently stored and wherein said method further comprises:

varying the speed at which the envelope curve addresses are read to thereby vary the duration of the envelope curve samples delivered to the instrument modulation controls.

3. The method of claim 2 wherein the envelope curve samples are stored in a read-only memory and the envelope curve sample addresses are stored in a random access memory and wherein the step of sequentially reading the stored addresses comprises:

reading all memory elements of the random access memory with the same clock frequency.

4. The method of claim 3 wherein at least some of the stored curve samples include a repeat command and wherein said method further comprises:

repetitively reading the read-only memory addresses stored in the random access memory in response to a repeat command.

5. Apparatus for generating digitally coded signals commensurate with envelope curves corresponding to polyphonic sounds to be produced by an electronic musical instrument comprising:

means for permanently storing value information which defines a plurality of envelope curve samples;

means for storing the addresses of stored envelope curve samples commensurate with the sound instantaneously desired, said address storing means comprising random access memory means having a number of memory elements equal to the number of envelope curves to be simultaneously generated, said address storing means further including a random access value information memory;

address counter means for sequentially reading the stored addresses, said address counter means addressing said random access memory means in parallel;

means for reading the stored curve samples which are commensurate with the stored addresses from said permanent storing means at a first rate of speed;

means for delivering to said address storing means value information memory the sample curve value information read from said permanent storing means at said first rate of speed, the instantaneous value information of the curve sample being read being thereby stored;

means responsive to an externally generated curve change command signal for sampling the value information commensurate with a second permanently stored envelope curve sample at a second rate of speed, said second rate of speed being greater than said first rate of speed;

comparator means for comparing the curve sample value information stored in said value information random access memory with the value information commensurate with the second envelope curve sample upon receipt of an externally generated curve change command, said comparator means producing an output signal commensurates with said stored value information equalling the value information of the said second envelope curve;

means responsive to an output signal produced by said comparator means for causing the said second envelope curve to be read from said permanent storing means at said first rate of speed and for causing the value information comprising said second envelope curve to be delivered for storage to said value information random access memory; and means for delivering the read curve sample value information to modulation controls in the instrument.

6. The apparatus of claim 5 wherein said random access memory means includes:

an interval memory which stores address fractions of the addresses of the curve samples stored in said curve sample storing means, and wherein said means for permanently storing curve samples comprises:

a read only memory; and wherein said apparatus further comprises:

summing means connected to said interval random access memory for complementing said address fractions to form complete address words.

7. The apparatus of claim 6 further comprising:

multiplexer means, said multiplexer means being responsive to externally generated control signals for selectively loading in said random access memory an envelope curve start address, a current address word as provided by said summing means and a read only memory address read from said read only memory.

8. The apparatus of claim 7 wherein said summing means increments an address value stored in said curve random access memory by entire units, said summing means being selectively switchable.

* * * * *